US008387753B2

(12) United States Patent
Kieffer et al.

(10) Patent No.: US 8,387,753 B2
(45) Date of Patent: Mar. 5, 2013

(54) ERGONOMIC EXTENDABLE/RETRACTABLE LADDER

(75) Inventors: Mitchell I. Kieffer, Minneapolis, MN (US); Craig S. Aizman, St. Louis Park, MN (US); Bruce A. Hillukka, Hanover, MN (US); Michael J. Kelly, Hastings, MN (US); Wayne A. Shakal, Taylors Falls, MN (US)

(73) Assignee: Core Distribution, Inc., Minneapolis, MN (US)

( * ) Notice: Subject to any disclaimer, the term of this patent is extended or adjusted under 35 U.S.C. 154(b) by 1057 days.

(21) Appl. No.: 11/427,896

(22) Filed: Jun. 30, 2006

(65) Prior Publication Data

US 2008/0000723 A1 Jan. 3, 2008

(51) Int. Cl.
*E06C 1/00* (2006.01)

(52) U.S. Cl. ..... 182/195

(58) Field of Classification Search ..... 182/195
See application file for complete search history.

(56) References Cited

U.S. PATENT DOCUMENTS

| | | | | | |
|---|---|---|---|---|---|
| 329,494 | A | * | 11/1885 | Schweinfurt | 292/175 |
| 1,712,942 | A | | 5/1929 | Smith | |
| 2,194,856 | A | | 3/1940 | Kostuk | |
| 2,993,561 | A | | 7/1961 | Watson | |
| 3,033,309 | A | | 5/1962 | Fugere | |
| 3,451,506 | A | | 6/1969 | Neal | |
| 3,653,463 | A | | 4/1972 | Neal et al. | |
| 4,002,223 | A | | 1/1977 | Bernkrant | |
| 4,086,980 | A | | 5/1978 | Shortes et al. | |
| 4,119,177 | A | | 10/1978 | Andersson | |
| 4,429,766 | A | | 2/1984 | Alimbau Marques | |
| 4,448,283 | A | | 5/1984 | Marques | |
| 4,457,391 | A | | 7/1984 | Alimbau Marques | |
| 4,574,918 | A | | 3/1986 | Marques | |
| 4,627,149 | A | | 12/1986 | Colas | |
| 4,967,484 | A | | 11/1990 | Nosek | |
| 4,989,692 | A | | 2/1991 | Min | |
| 5,417,511 | A | | 5/1995 | Warden | |
| 5,492,430 | A | | 2/1996 | Jones | |
| 5,495,915 | A | | 3/1996 | Weston et al. | |
| 5,577,574 | A | * | 11/1996 | Joseph | 182/180.1 |
| 5,577,722 | A | * | 11/1996 | Glassberg | 473/457 |
| 5,593,239 | A | | 1/1997 | Sallee | |
| 5,603,435 | A | * | 2/1997 | Fenwick | 222/240 |
| 5,738,186 | A | | 4/1998 | Jones | |
| 5,743,355 | A | | 4/1998 | McDonnell et al. | |
| 5,803,290 | A | * | 9/1998 | Bongiorno | 215/384 |

(Continued)

FOREIGN PATENT DOCUMENTS

| | | | |
|---|---|---|---|
| AU | 43797/79 | A1 | 8/1980 |
| DE | 4408095 | A1 | 9/1995 |

(Continued)

*Primary Examiner* — Alvin Chin Shue
(74) *Attorney, Agent, or Firm* — Fredrikson & Byron, P.A.

(57) ABSTRACT

An extendable/retractable ladder assembly includes a first column and a second column, the first column nesting in the second column, and a first rung coupled to, and extending from the second column. A ladder assembly bracket includes a collar portion, which extends about the second column, and a rung portion, which extends from the collar portion into the first rung. The collar portion may be gripped by a hand of an operator in order to position a thumb of the hand in engagement with a button to retract a locking pin of a latch assembly mounted within the rung portion of the bracket.

11 Claims, 6 Drawing Sheets

U.S. PATENT DOCUMENTS

| | | | | |
|---|---|---|---|---|
| 5,924,658 | A | 7/1999 | Shiery et al. | |
| 6,006,399 | A | 12/1999 | Massaro | |
| 6,006,952 | A | 12/1999 | Lucas | |
| 6,361,002 | B1 | 3/2002 | Cheng | |
| 6,402,330 | B1 * | 6/2002 | Scheidegg | 359/879 |
| D462,453 | S | 9/2002 | Johansson | |
| 6,461,074 | B2 | 10/2002 | Taylor | |
| 6,520,291 | B2 | 2/2003 | Andrey | |
| 6,676,095 | B2 * | 1/2004 | Dal Pra' | 248/230.3 |
| 6,708,800 | B2 * | 3/2004 | Kieffer et al. | 182/195 |
| 6,999,253 | B1 * | 2/2006 | Niwa et al. | 359/892 |
| 2003/0029676 | A1 | 2/2003 | Gibson et al. | |
| 2003/0079356 | A1 * | 5/2003 | Crain et al. | 33/296 |
| 2004/0020718 | A1 | 2/2004 | Kieffer et al. | |
| 2004/0195043 | A1 | 10/2004 | Johansson | |
| 2006/0071040 | A1 * | 4/2006 | Young | 222/484 |

FOREIGN PATENT DOCUMENTS

| | | | |
|---|---|---|---|
| DE | 19501689 | | 8/1996 |
| DE | 19530452 | | 2/1997 |
| EP | 1516999 | A2 | 3/2005 |
| EP | 1728966 | A1 | 12/2006 |
| WO | 91/15651 | | 10/1991 |
| WO | 93/02271 | | 2/1993 |

* cited by examiner 100
a
b
c
d
e
x
11
12
13
14
15
20
23
Ha
Hb
Hc
Hd
Hx

ERGONOMIC EXTENDABLE/RETRACTABLE LADDER

TECHNICAL FIELD

The present invention pertains to ladders and more particularly to extendable/retractable ladders.

BACKGROUND

Extendable/retractable ladders typically include rungs supported between stiles formed from telescoping columns, which can be expanded to separate apart from one another, for extension of the ladder, or collapsed together for retraction of the ladder. These ladders often include mechanisms, which hold the columns relative to one another in an extended state; these mechanisms can be manually released to allow the columns to collapse together for retraction of the ladder. There is a need for extendable/retractable ladder features, pertaining to these mechanism, which provide for improved ladder construction and assembly as well as for improved handling of the assembled ladder.

BRIEF DESCRIPTION OF THE DRAWINGS

The following drawings are illustrative of particular embodiments of the present invention and therefore do not limit the scope of the invention. The drawings are not to scale (unless so stated) and are intended for use in conjunction with the explanations in the following detailed description. Embodiments of the present invention will hereinafter be described in conjunction with the appended drawings, wherein like numerals denote like elements.

DETAILED DESCRIPTION

The following detailed description is exemplary in nature and is not intended to limit the scope, applicability, or configuration of the invention in any way. Rather, the following description provides practical illustrations for implementing exemplary embodiments of the present invention.

Figures 1A, 1B, 1C, 1D, 1E:
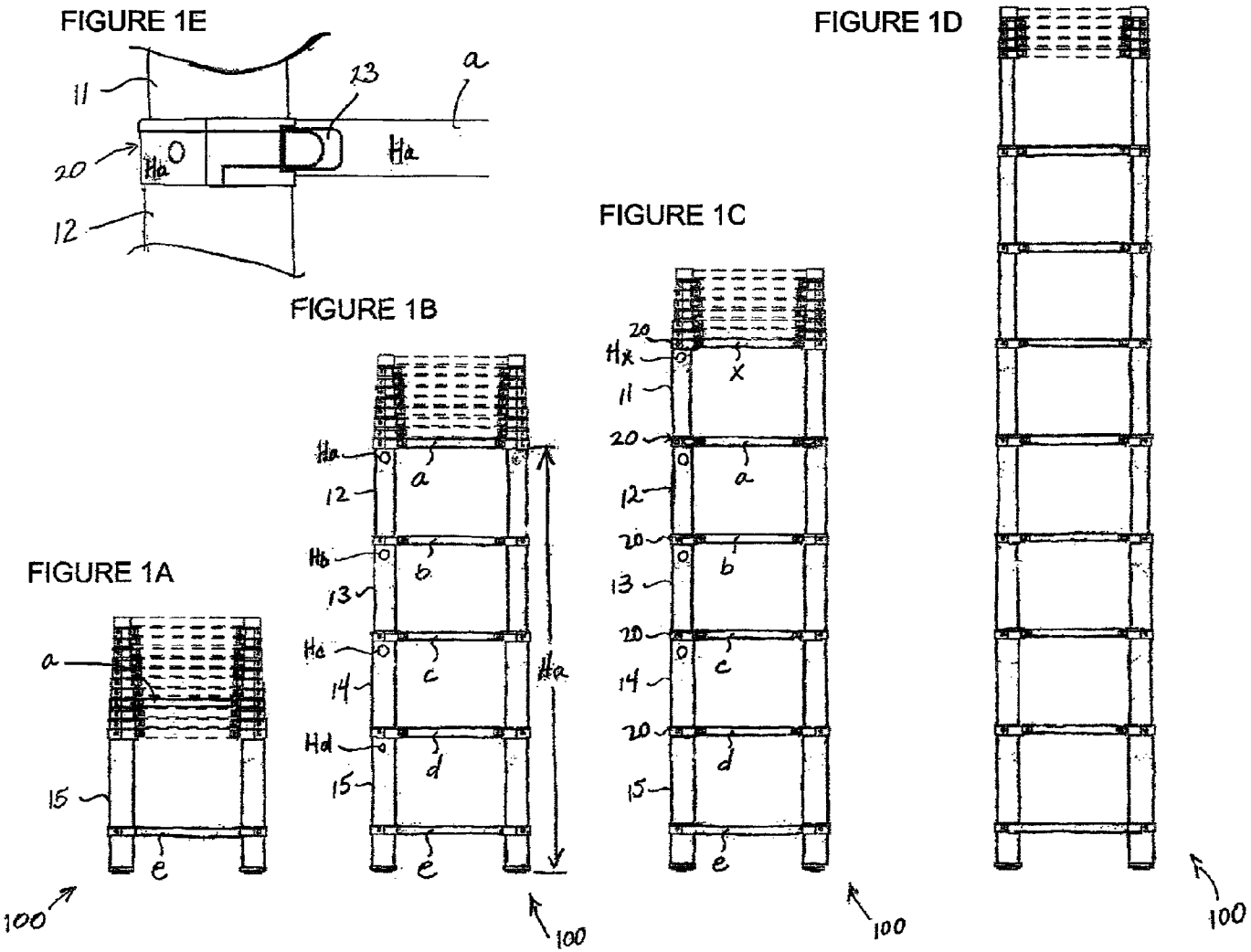
FIGS. 1A-D are front plan views of a ladder according to some embodiments of the present invention.
FIG. 1E is a detail view of a portion of the ladder shown in FIGS. 1A-D.

FIGS. 1A-D are front plan views of a ladder 100, extended to various heights, according to some embodiments of the present invention. Ladder 100 includes two opposing stiles each formed by a plurality of telescoping columns; labeled columns 11, 12, 13, 14, and are shown making up a portion of the left-hand stile. According to the illustrated embodiment each opposing column of each stile includes a rung extending therebetween, wherein each rung is coupled on either end to an opposing column by a bracket 20; in the figures, each of labeled rungs x, a, b, c and d are shown coupled to corresponding columns 11, 12, 13, 14 and 15 by bracket 20, which will be described in greater detail below. FIGS. 1B-C further illustrate indicating marks $H_a$, $H_b$, $H_c$, and $H_d$ at locations indicated by circles on columns 11, 12, 13 and 14, respectively; according to the illustrated embodiment, each indicating mark designates a height of the subscripted rung, adjacent to the mark, for example, $H_a$ indicating a height Ha of rung a shown in FIG. 1B. Alternately, indicator marks may designate a height of a rung just below the rung in proximity to the mark, for example, Ha designating the height of rung b. According to some embodiments the marks are located on columns 12-15 as shown in FIGS. 1B-C, but, according to a preferred embodiment of the present invention, such indicating marks are located either on brackets 20 or on the rungs so that a user of the ladder can clearly see the marks when the ladder is fully collapsed as shown in FIG. 1A. Examples of these preferred alternate locations, in proximity to rung a, are shown in FIG. 1E. The height indicators may be printed, adhered to, etched, molded, or any combination thereof on any suitable portion of ladder 100. With reference to FIGS. 1A, B and E, it may be appreciated that a user of ladder 100 who references the height indicators when ladder 100 is fully collapsed (FIG. 1A) will know which rung to select in order to extend the ladder to a desired height. According to some alternate embodiments, indicating marks are numbers assigned to each rung, rather than heights.

Figure 2:
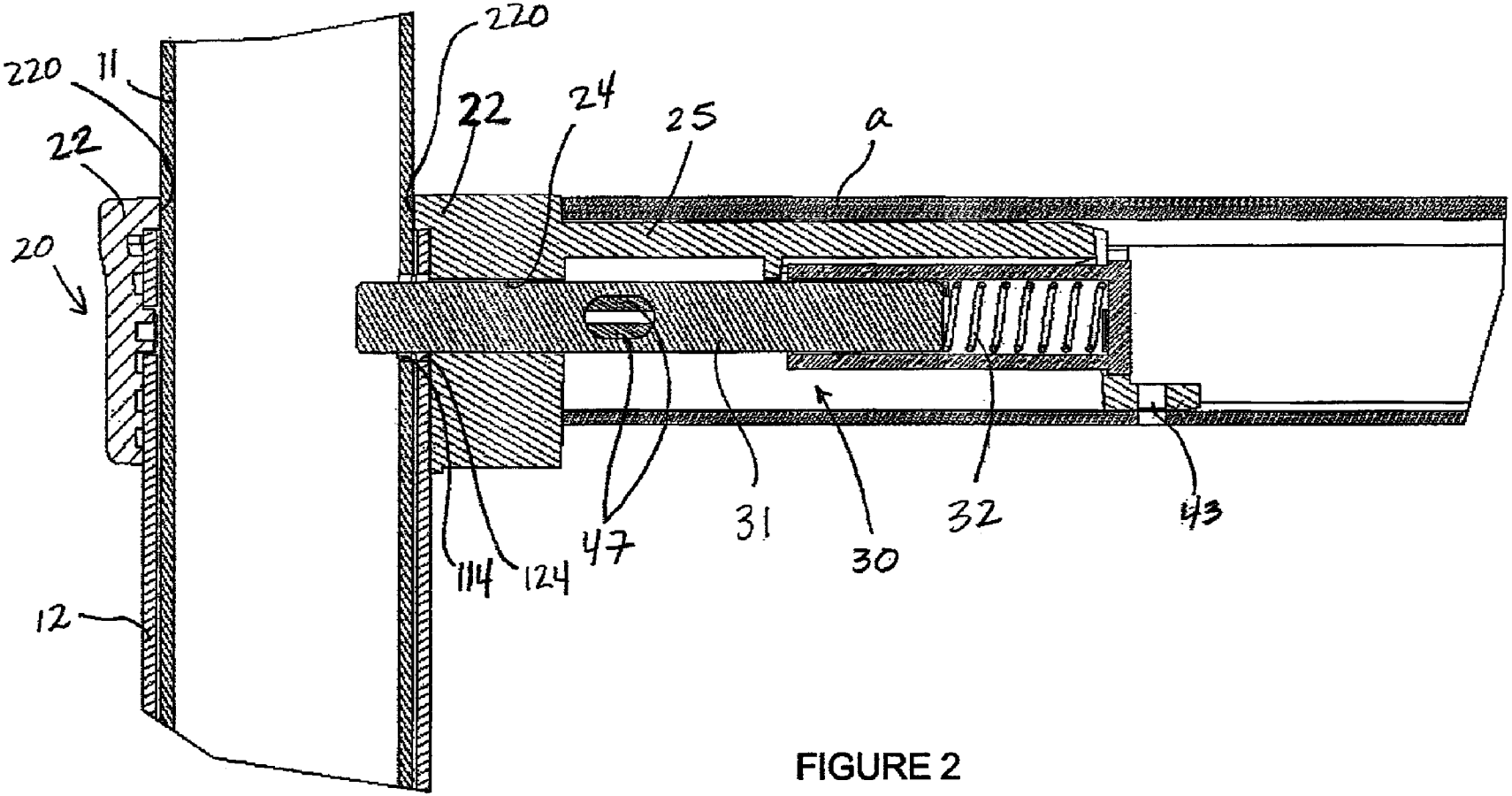
FIG. 2 is a front plan view, including a cut-away section, of a portion of the ladder shown in FIGS. 1A-D, according to some embodiments of the present invention.
Figure 3:
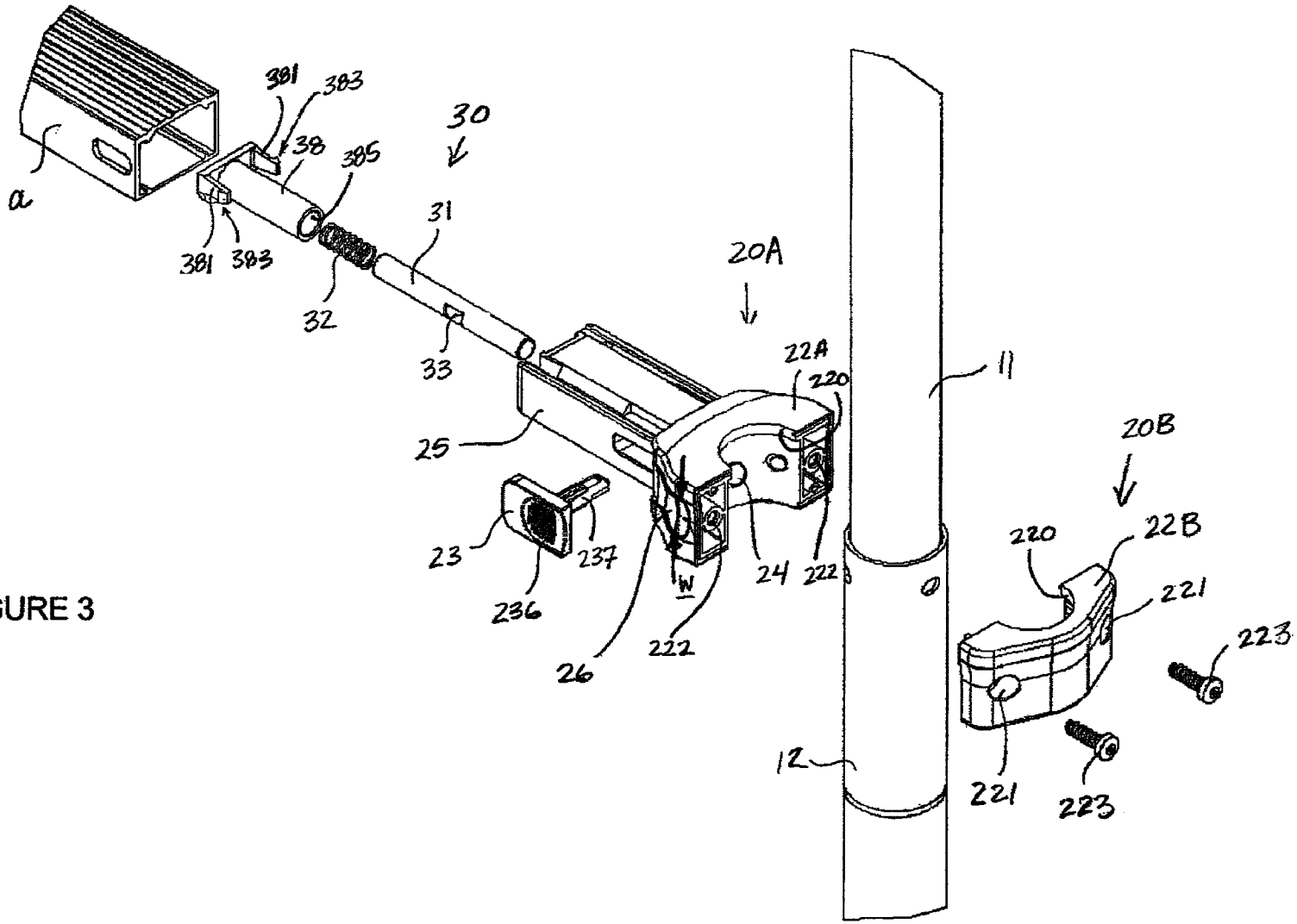
FIG. 3 is an exploded perspective view of the portion of the ladder shown in FIG. 2.

FIG. 2 is a front plan view, including a cut-away section, of a portion of the ladder shown in FIGS. 1A-D, according to some embodiments of the present invention; and FIG. 3 is an exploded perspective view of the portion of the ladder shown in FIG. 2. FIG. 2 illustrates column 11 nested within column 12 and bracket 20 joining rung a to column 12; bracket 20 includes a rung portion 25 extending into rung a, for example, being coupled to rung a via a rivet (not shown) that extends through rivet hole 43, and a collar portion 22 extending about column 12. FIG. 2 further illustrates a latch assembly 30 mounted in rung portion 25 of bracket 20 and including a locking pin 31, being biased by a spring 32, extending through side holes 24, 124 and 114 of bracket 20, column 12 and column 11, respectively, to reversibly lock column 11 in an extended position with respect to column 12, for example as illustrated in FIG. 1C. Locking pin 31 and spring 32 may be formed of stainless steel. FIGS. 2 and 3 illustrate collar portion 22 including an internal guiding surface 220 for the extension and retraction of column 11 within column 12, when locking pin 31 is retracted. Latch assembly 30 will be described in greater detail below.

FIG. 3 further illustrates bracket 20 formed from a first piece 20A, which includes rung portion 25 and a first part 22A of collar portion 22, and a second piece 20B, which includes a second part 22B of collar portion. According to certain embodiments, bracket pieces 20A, 20B are formed of a molded thermoplastic, for example a glass filled nylon, such as PA6-GF30%. According to the illustrated embodiment, first and second pieces 20A, 20B come together about column 12 being coupled together by bolts 223, each extending through respective bores 221 of collar second part 22B, and respective bores 222 of collar first part 22A. Such a two piece design for bracket 20 may increase ease of assembly and may provide a better fit of bracket about columns 11 and 12. According to certain embodiments, bores 221 include counter bores so that heads of bolts 223 are recessed when joining pieces 20A and 20B together; this may prevent and/or discourage disassembly of bracket 20, once assembled. First and second pieces 20A, 20B, according to alternate embodiments, are coupled together with other types of mechanical fasteners known to those skilled in the art, or via interlocking features, or via any other type of coupling mechanisms, for example adhesive or thermal bonding.

Figure 4:
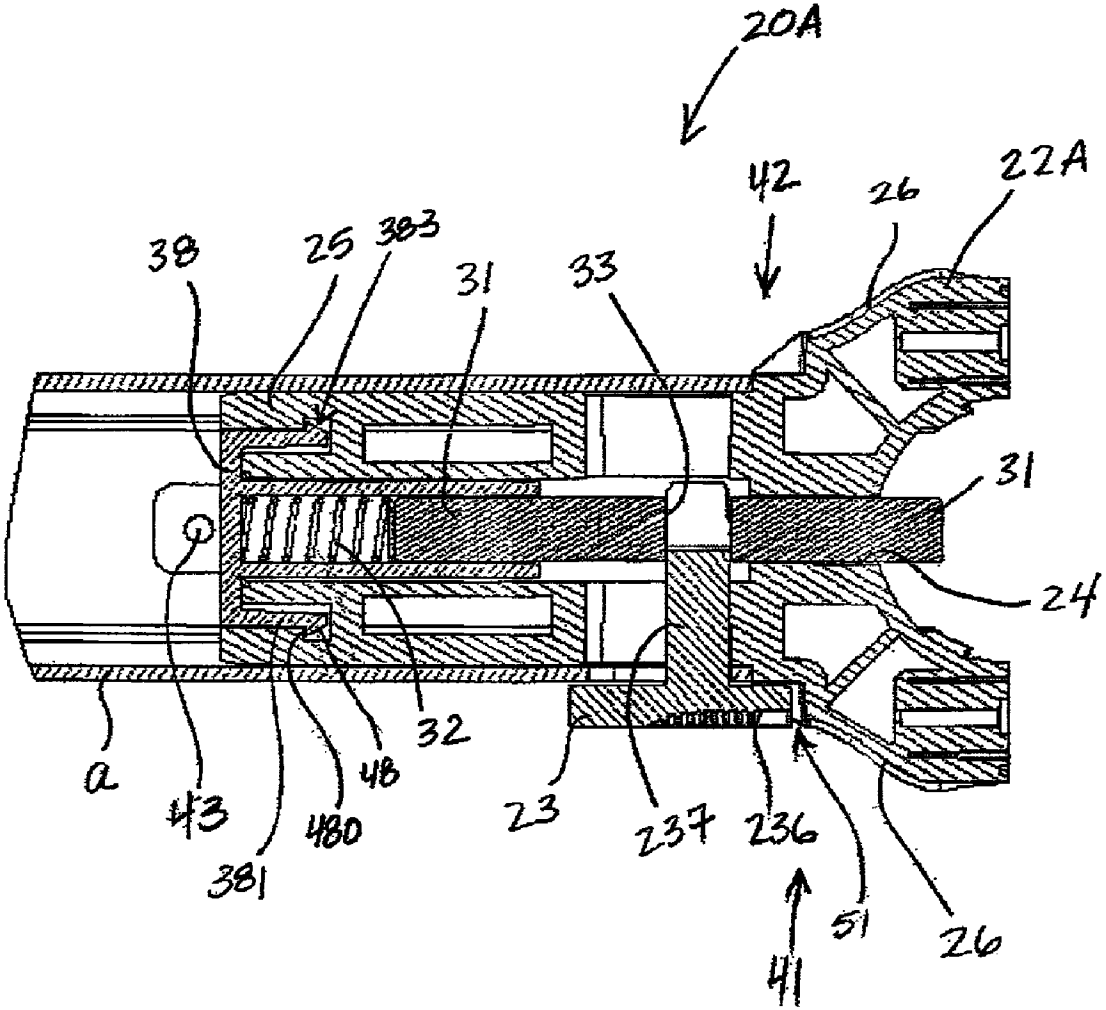
FIG. 4 is a section view of a portion of a bracket, according to some embodiments of the present invention.
Figure 5B:
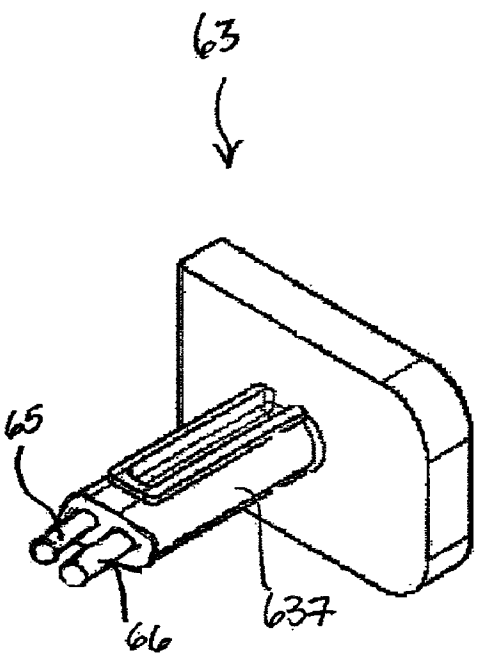
FIG. 5B is a perspective view of the latch assembly component, according to some alternate embodiments of the present invention.

With further reference to FIG. 3, a button 23 that couples with locking pin 31, in order to facilitate retraction of locking pin 31, is shown disposed adjacent to collar part 22A. FIG. 4 is a section view through rung a in which bracket piece 20A is inserted; FIG. 4 shows the coupling of button 23 to pin 31 when both are assembled into bracket piece 20A. According to the illustrated embodiment, locking pin 31 includes a cross-hole 33 through which a shank 237 of button 23 is inserted for coupling thereto. According to an alternate embodiment locking pin includes two cross-holes to accommodate a button 63 which is illustrated in FIG. 5B and described below.

Figure 6:
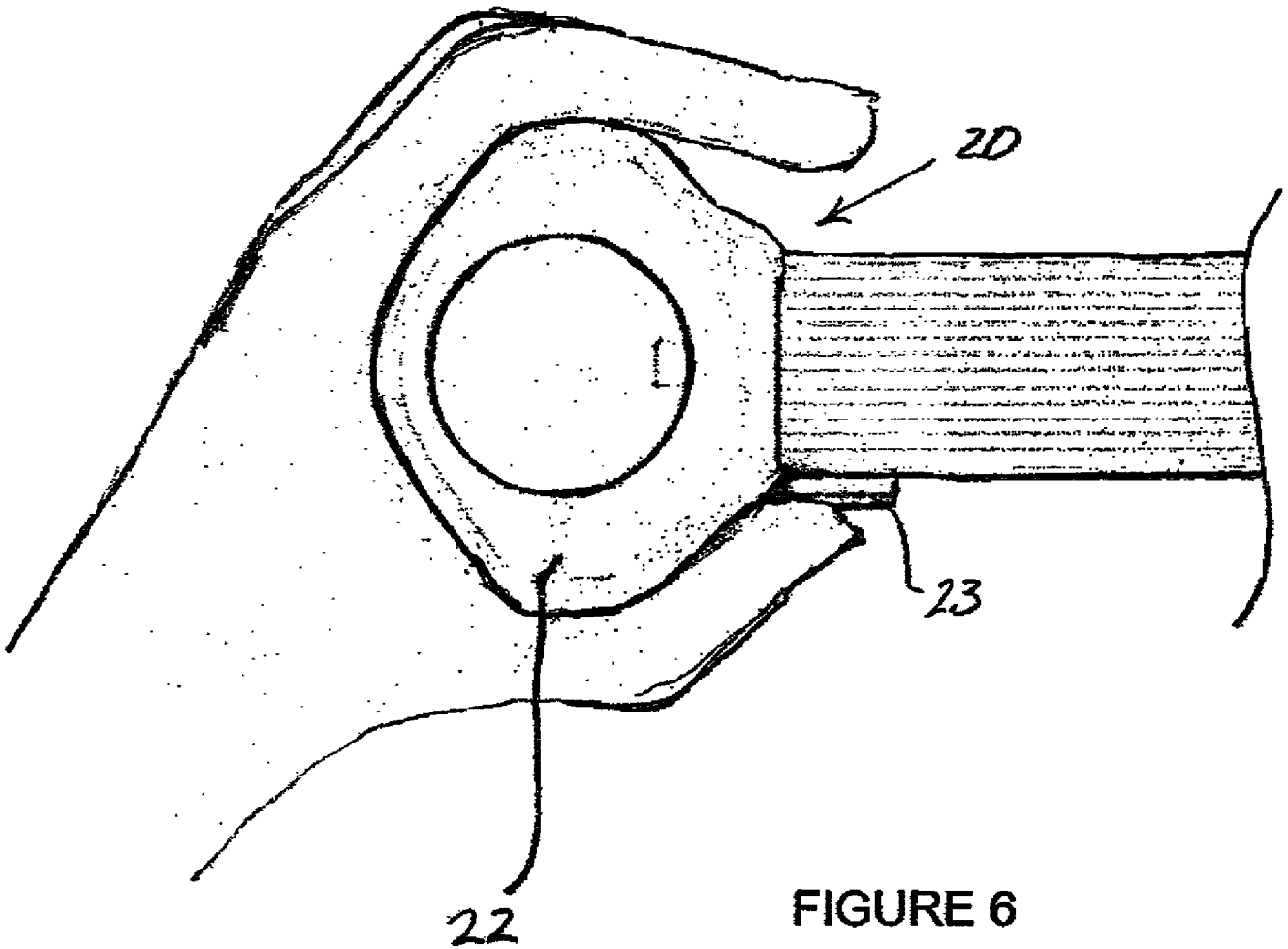
FIG. 6 is a top plan view of a portion of a ladder being gripped by an operator.

FIGS. 3 and 4 further illustrate button 23 including a recess 236, to receive a thumb of a hand, when the hand grasps about second column 12, and collar portion 22 including recesses 26 defining a gripping portion to accommodate a portion of the hand grasping about column 12. According to the illustrated embodiment, recesses 26 and 236 guide a hand for gripping the ladder in order to push button along rung a in order to retract pin 31, against spring 32, out from side holes 24, 124 and 114 (FIG. 2) so that column 11 can retract into column 12. For reference, FIG. 6 illustrates a position of a hand gripping about collar portion 22 of bracket 20 to engage button 23. Recesses 26 define for an operator a preferred position for the operator to grip ladder 100 in order to engage button 23, so that the hand of the operator is prevented from sliding up over the bracket 20 of column 12 where it may be impinged by the descending bracket 20 of column 11 (FIG. 1 C) collapsing into column 12 when button 23 is pushed by a thumb of the operator's hand. According to certain embodiments, a width W of each recess 26 is greater than approximately 12 millimeters, preferably approximately 16 millimeters, and a depth D of each recess 26 may be approximately 1 millimeter or greater. According to the illustrated embodiments, recesses 26 are formed on a first side 41 of rung a and a second side 42 of rung a (FIGS. 4A-B), but, according to alternate embodiments, recesses 26 extend about collar portion 22 to form a continuous recess from first side 41 to second side 42. FIG. 4A further illustrates a gap 51 between button 23 and an inner edge of recess 26 when pin 31 is in the locking position; gap 51 may prevent pinching of a portion of a hand located in recess 26, with thumb extending in proximity to button recess 236 after releasing button 23 from retracting pin 31.

Figure 5A:
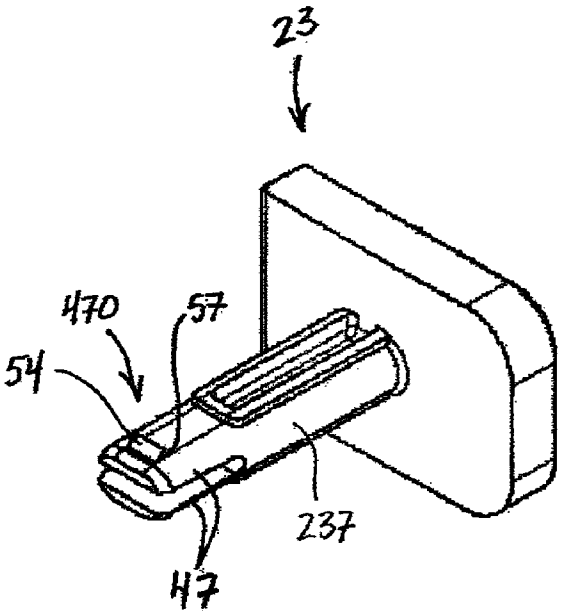
FIG. 5A is a perspective view of a latch assembly component, according to some embodiments of the present invention.

FIG. 5A is a perspective view of button 23 wherein button shank 237 is shown including opposing flexible tabs 47 that deflect toward one another when shank 237 is inserted within cross-hole 33 of pin 31 to assembly latch mechanism 30. According to the illustrated embodiment, each tab 47 includes a projection 470 having a tapered leading edge 54, which allows insertion of button shank 237 into cross-hole 33 for assembly, and an upright trailing edge 57 to prevent pulling of button shank 237 out from cross-hole 33, once assembled. Button 23 is, preferably, a single piece integrally formed, for example, via molding of a thermoplastic material, for example, a glass filled nylon, such as PA6-GF30%. FIG. 5B is a perspective view of a button 63, according to some alternate embodiments of the present invention. FIG. 5B illustrates button 63 including a shank 637, which includes protrusions 65 and 66; button 63 is also, preferably, a single piece being integrally formed. According to the alternate embodiment of FIG. 5B, each of shank protrusions 65 and 66 is press fit into a corresponding cross-hole of a locking pin, similar to locking pin 31.

Referring back to FIGS. 3 and 4A, it may be seen that latch assembly 30 further includes a carrier 38 to hold locking pin 31 and spring 32 within rung portion 25 of bracket 20. According to the illustrated embodiment, carrier 38 includes opposing flexible clip arms 381 that deflect toward one another when carrier 38 is inserted into rung portion 25 of bracket for assembly; each clip arm 381 includes a projection 383 having a tapered leading edge 48, allowing the insertion, and an upright trailing edge 480 preventing withdrawal of carrier 38 from rung portion, once assembled therein. Carrier 38 may be formed of a molded thermoplastic, for example, an ABS.

In the foregoing detailed description, the invention has been described with reference to specific embodiments. However, it may be appreciated that various modifications and changes can be made without departing from the scope of the invention as set forth in the appended claims.

The invention claimed is:

1. An extendable/retractable ladder assembly, comprising:

a first column and a second column, the first column nesting in the second column;

a first rung extending from the first column;

a second rung extending from the second column;

a first bracket including a collar portion extending about the first column and a rung portion extending from the collar portion and into the first rung in order to couple the first rung to the first column;

a second bracket including a collar portion extending about the second column and a rung portion extending from the corresponding collar portion and into the second rung in order to couple the second rung to the second column;

a latch assembly mounted within the rung portion of the second bracket, the latch assembly including a locking pin and a spring, the spring exerting a biasing force against the locking pin to engage the locking pin with the first column and the second column in order to reversibly lock the first column in an extended position with respect to the second column; and a button coupled to the locking pin and disposed outside the second rung in proximity to the collar portion of the second bracket, the button being moveable along the second rung, in a direction that is generally aligned with a direction in which the second rung extends, away from the collar portion, in order to retract the locking pin against the biasing force of the spring and thereby allow the first column to retract and collapse within the second column;

wherein the collar portion of the second bracket includes an outer surface and a recess formed in the outer surface, and the button includes a recess, the recess of the collar portion and the recess of the button being located in proximity to one another, in order to simultaneously accommodate a portion of a hand of an operator, which portion of the hand includes a thumb of the operator; and the recess of the collar portion and the recess of the button both extend in the direction in which the button is moveable said collar and said button recess are adapted for a user's hand to wrap around the collar and for the user's thumb to extend into the button recess from a side of the button adjacent to the collar and not from below so that, when the portion of the hand is accommodated by the recess of the collar portion and by the recess of the button, the thumb is positioned to apply a force to the button in the direction in which the second rung extends.

2. The ladder of claim 1, wherein a width of the recess of the collar portion is greater than approximately 12 millimeters.

3. The ladder of claim 1, wherein the recess extends around the collar portion of the second bracket from a first side of the second rung to a second side of the second rung.

4. The ladder of claim 1, wherein the second bracket is formed from a first piece and a second piece, the first piece including the rung portion and a part of the collar portion extending about a first side of the second column adjacent to the second rung, and the second piece including another part of the collar portion extending about a second side of the second column opposite the first side.

5. The ladder of claim 4, further comprising a bolt coupling the first piece to the second piece.

6. The ladder of claim 5, wherein the first and second pieces each include a bore to receive the bolt and the second piece further includes a counter bore so that a head of the bolt is recessed from an outer surface of the second piece.

7. The ladder of claim 4, further comprising a first bolt and a second bolt, the first and second bolts coupling the first piece to the second piece and being disposed on opposite sides of the bracket collar portion.

8. The ladder of claim 1, wherein:

the locking pin includes a cross-hole; and the button includes a shank having a portion extending through the cross-hole of the locking pin to couple the button to the locking pin.

9. The ladder of claim 8, wherein the portion of the button shank includes opposing flexible tabs having projections to hold the shank within the cross-hole.

10. The ladder of claim 8, wherein:

the locking pin further includes another cross-hole; and the portion of the button shank includes a pair of protrusions, each of the protrusions being press fit into a corresponding one of the cross-holes.

11. The ladder of claim 1, further comprising:

a third column, the second column nesting in the third column;

a third rung coupled to and extending from the third column;

a lowermost column accommodating nesting of the first, second and third columns;

a lowermost rung coupled to and extending from the lowermost column; and an indicating mark disposed in proximity to the outer surface of the collar portion of the second bracket;

the indicating mark corresponding to a height of one of the first and second rungs when the ladder is fully extended between the first rung and the lowermost rung of the ladder.

* * * * *